US006925952B1

(12) United States Patent
Popovic

(10) Patent No.: US 6,925,952 B1
(45) Date of Patent: Aug. 9, 2005

(54) ANTI-FOULING LAMINATE FOR BOAT HULLS

(76) Inventor: David J. Popovic, 16748 Kamalin Ct., Clermont, FL (US) 34711-9519

( * ) Notice: Subject to any disclaimer, the term of this patent is extended or adjusted under 35 U.S.C. 154(b) by 23 days.

(21) Appl. No.: 10/822,832

(22) Filed: Apr. 13, 2004

(51) Int. Cl.[7] ..... B63B 59/00
(52) U.S. Cl. ..... 114/222; 156/71
(58) Field of Search ..... 114/222; 138/146; 156/71; 204/196.03, 196.05, 196.06, 196.37; 405/216

(56) References Cited

U.S. PATENT DOCUMENTS

| | | | | |
|---|---|---|---|---|
| 3,554,154 A | * | 1/1971 | Thomas | 114/222 |
| 3,661,506 A | | 5/1972 | Watkins | 422/6 |
| 3,990,381 A | | 11/1976 | Shepherd et al. | 114/67 R |
| 4,012,503 A | | 3/1977 | Freiman | 424/641 |
| 4,603,653 A | * | 8/1986 | Bews | 114/222 |
| 4,772,344 A | | 9/1988 | Andoe | 156/64 |
| 5,035,759 A | | 7/1991 | Andoe | 156/64 |
| 5,098,473 A | | 3/1992 | Hani et al. | 106/18.33 |
| 5,226,380 A | | 7/1993 | Fischer | 114/222 |
| 5,423,631 A | * | 6/1995 | Inoue | 405/216 |
| 5,814,172 A | * | 9/1998 | Cox et al. | 156/71 |
| 6,173,669 B1 | | 1/2001 | Staerzl | 114/222 |

* cited by examiner

*Primary Examiner*—Lars A. Olson
(74) *Attorney, Agent, or Firm*—William B. Noll

(57) ABSTRACT

A thin laminate for application to a submerged object, such as a boat hull, to provide anti-fouling protection to the object. The laminate comprises a first layer of a transfer adhesive, a second strengthening layer of a plastic or synthetic rubber film, a third layer of a blended mixture of a synthetic rubber and cuprous oxide, and a removable fourth layer of a plastic film.

17 Claims, 1 Drawing Sheet

ANTI-FOULING LAMINATE FOR BOAT HULLS

FIELD OF THE INVENTION

This invention is directed to the field of anti-fouling systems and mechanisms for treating the hulls of marine vessels, more particularly to a thin multi-layered cuprous oxide containing laminate for direct application to the hull of a marine vessel.

BACKGROUND OF THE INVENTION

The present invention relates to an anti-fouling laminate that can be easily applied to the hull of a marine vessel, where the application eliminates the need for a primer coat or sanding of the hull. Fouling by marine growth has been a major problem for many years.

The organisms responsible for fouling can be classified into two major categories. Shelled organisms, also referred to as "hard-fouling" types, include barnacles, tube worms, encrusting bryozoans and mollusks. Organisms without a shell, referred to as "soft-fouling" types, include algae such as seaweed, tunicates, filamentous bryozoans, and hydroids.

Fouling of a ship's hull by any of the aforementioned organisms is most undesirable since it increases both fuel consumption and maintenance costs resulting from the frequent dry docking required to clean and repair the submerged portions of the hull.

Coatings conventionally employed to protect submerged surfaces from the attachment and growth of fouling organisms usually contain a toxicant and a carrier consisting, at least in part, of a rosin (a mixture of five, isomeric diterpene acids, the major component being abietic acid). A film-forming synthetic polymer is often included as part of the carrier. Many coatings also contain a pigment such as titanium dioxide and one or more organic liquids.

Copper cladding had been used successfully for years until the introduction of vessels with iron hulls which prevented its use because of the potential for galvanic action between the dissimilar metals. However, with the introduction of non-metallic hulls, the use of copper compounds again regained prominence. For example, copper salts are used in the majority of anti-fouling paints today.

New techniques have emerged to effect an improved system for minimizing marine growth on boat hulls, and in an effort to meet certain governmental requirements to avoid water decontamination through the use of materials that can harm marine life, by way of example. Certain of these techniques are described in the following U.S. Patents:

a.) U.S. Pat. No. 3,661,506, to Watkins, discloses a system for controlling marine growth on submerged surfaces in which chemical anti-foulants are constantly permeated and diffused by absorption through a permeable non-porous membrane, preferably formed as a plastic sheath, having the inner surfaces thereof continuously supplied with the diffusable chemical from a replenishable supply; the plastic sheath being selected for non-destructible and controlled permeation by a selected chemical which is repugnant or toxic to limnological and marine growth. The membrane may be backed up by a non-permeable barrier to isolate permeation to the membrane and in certain instances to form a reservoir system with the membrane. The barrier structure so formed is readily submersible and presents an environmental contacting surface which is highly repellent to marine organisms. However, the system thereof is permeable with the water retention increasing the amount of energy necessary to propel the vessel through the water.

b.) U.S. Pat. No. 3,990,381, to Shepherd et al., teaches a hydrophilis polymer coating for underwater structures, where the coating has encapsulated therein either or both anti-fouling agents or pigments to reduce the drag of the structure.

c.) U.S. Pat. No. 4,012,503, to Freiman, relates to a coating composition used to control barnacles. Such compositions may be toxicant compositions containing the combination of tri-in-butyltin fluoride with zinc oxide and specified substituted triazines effectively inhibit the development of marine organisms, including barnacles and algae, that are responsible for fouling. These compositions are particularly useful as the active component in anti-fouling coatings.

d.) U.S. Pat. No. 5,035,759, to Andoe, is directed to a method of protecting the hulls of marine vessels from fouling. The method involves the application of thin metallic films to the hull of a boat, and includes the use of various techniques for application of the film, techniques for preventing the touching of dissimilar metals, techniques for insuring that dissimilar metals are insulated and isolated from one another, insuring that active or passive cathodic protection systems are not on the same surface plane as the attached films and other techniques.

e.) U.S. Pat. No. 5,098,473, to Hani et al., discloses a process for producing a stable, gel-free dispersion of zinc pyrithione plus cuprous oxide biocide in paint as an anti-fouling agent for underwater structures.

f.) U.S. Pat. No. 5,226,380, to Fischer, teaches a covering material for underwater objects such as boat hulls or water intake pipes. The covering includes a waterproof coating such as adhesive or paint containing capsicum derivatives such as cayenne pepper or oleoresin capsicum, with the coating applied to the outer surface of the object to be protected, to repel marine organisms which might otherwise attach themselves to the object. However, the use of cayenne pepper can result in causing harm to one's skin.

The prior art, as reflected in the foregoing patents, are generally complex and costly systems to provide fouling protection to underwater structures, such as marine vessels. Such systems often require the need for the application of a primer coat, or other surface treatments, i.e. sanding, whereas the laminate hereof needs only a clean and dry surface. Further, the invention as disclosed herein is environmentally friendly as there is a minimized leaching of chemicals into the water, with no airborne contaminants into the air during application of the laminate to a boat hull. The manner by which the present invention achieves the goals hereof in a unique and cost effective way will become more apparent in the description which follows, especially when read in conjunction with the accompanying drawing.

SUMMARY OF THE INVENTION

The invention discloses a new and cost effective anti-fouling laminate having particular utility in providing protection for boat hulls. The laminate according to this invention is a multi-layered product comprises a first, semi-porous transfer adhesive to provide adhesion of the laminate to the hull of the boat. Overriding the first layer is a non-porous plastic or synthetic rubber film to improve adhesion, and to strengthen the laminate for removal, as may be required. A third layer, in contact with the second layer, comprises a blended mixture of a synthetic rubber, such as butyl rubber and cuprous oxide (Cu2O), where the range of cuprous oxide may vary between about 15 to 70%, by weight, with a preferred range being about 20 to 40%, by weight. As a final fourth or outer layer, the laminate may include a non-porous plastic film which is removed after application to a boat hull, for example, to thereby expose the third layer or anti-fouling surface to the water. This removable layer protects and extends the shelf life of the anti-fouling surface, while protecting the environment and the personnel handling the laminate. The laminate, when removed and replaced with a new laminate, is designed to promote recycling. Though the thickness may vary, where a 3 mil laminate has proven effective, it is contemplated that the thickness could range from 1 to 4 mils.

Accordingly a feature of this invention is the provision of a cost effective and readily applied anti-fouling laminate for use on boat hulls and other water submerged objects.

Another feature hereof lies in the use of a cuprous oxide containing laminate that is safe to handle and environmentally friendly.

Still a further feature of the invention is a multi-layered anti-fouling laminate that may be easily applied to a clean and dry boat hull without any further treatment of the boat hull.

An additional feature of this invention is a thin, yet strong, laminate that may be easily removed from the boat hull and the chemicals thereof recycled.

These and other features will become more apparent, especially to those skilled in the art, from a reading of the following specification and accompanying drawing.

DETAILED DESCRIPTION OF PREFERRED EMBODIMENT

Figure 1:
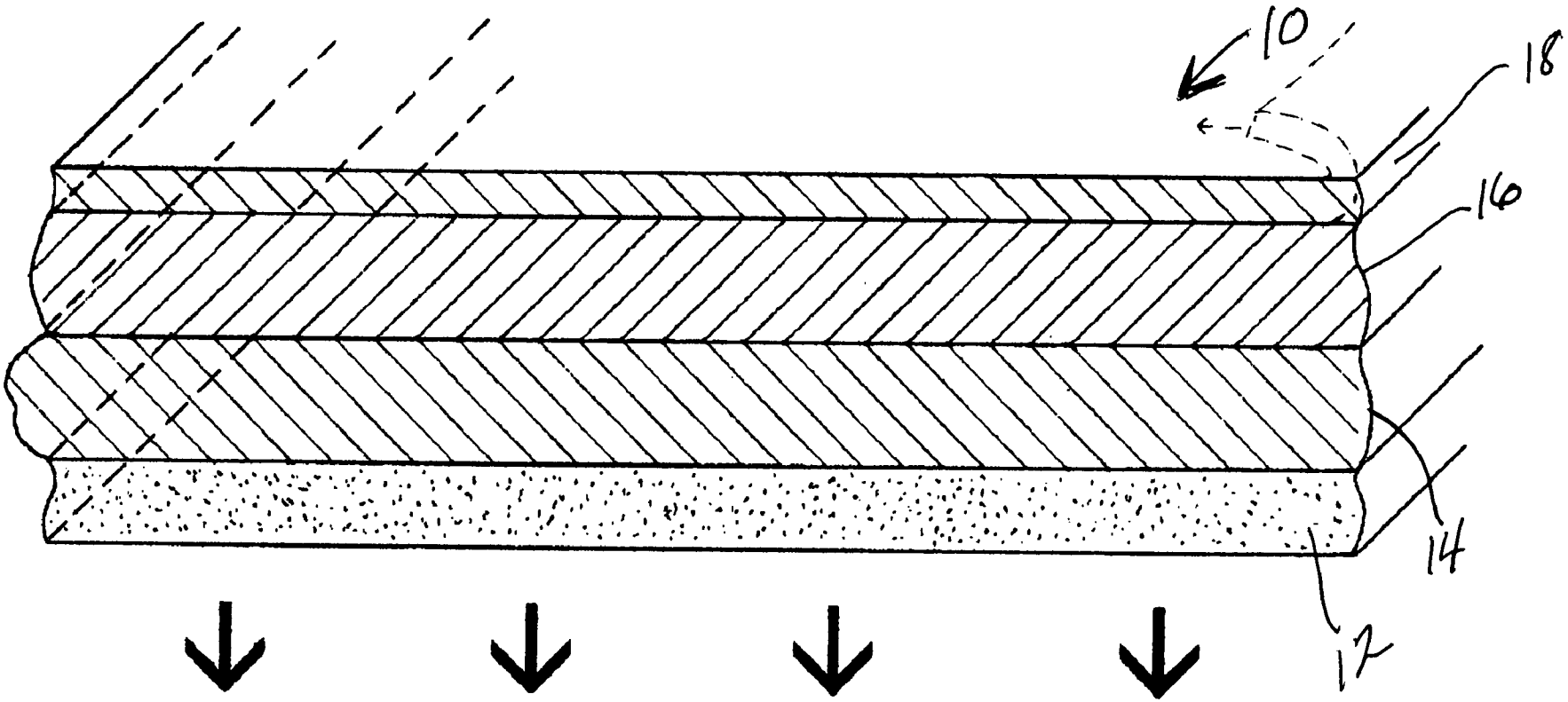
FIG. 1 is an enlarged, sectional perspective view for the application of a preferred anti-fouling laminate for boat hulls, and the like, according to this invention.

The present invention is directed to an anti-fouling laminate that may be readily applied to boat hulls and other underwater objects, where fouling protection is necessary. More particularly, the invention relates to a multi-layered laminate that is safe to handle and transport, easy to apply, and when desired, removed and recycled. The laminate will now be described with regard to the accompanying FIGURE.

Turning now to the FIGURE, there is illustrated a sectional perspective view for a preferred anti-fouling laminate 10 according to the invention, where the directional arrows indicate the side of the laminate 10 to be adhered to the hull surface. The laminate comprises a non-porous first or transfer adhesive layer 12, the function of which is to provide adhesion of the system to the boat hull surface. A preferred, nominal thickness for the first layer is about 0.002". Though a number of materials may be suitable for this application, an acrylic adhesive is preferred as several blends bond extremely well to low surface energy products and less aggressively to high surface energy materials. A commercial acrylic adhesive suitable for use in practicing this invention is produced by 3M Company under product code #7951. To facilitate shipping and storage until the manufacture of the laminate, this adhesive or first layer is typically supplied by the vendor having treated paper on the respective surfaces to protect and seal. When manufacturing the laminate, as later discussed, a first of the treated paper layers is removed, with the second paper layer removed at the time of applying the laminate to the desired structure.

The second layer 14 consists of a non-porous plastic or synthetic rubber film, with a nominal thickness of about 0.003", where a primary function is to provide strength to the laminate. For removing the laminate for replacement, strength can be helpful to give stability to the laminate.

The third or anti-fouling layer 16 is the critical component of the laminate 10. The anti-fouling layer comprises a blend consisting essentially of synthetic rubber, such as butyl, and cuprous oxide (Cu2O), where the cuprous oxide is held in suspension by the synthetic rubber. The blend may comprises cuprous oxide held in suspension by the synthetic rubber and may be present in an amount of 15% to 70% by weight, where a preferred amount may be between about 20% to 40%. A dry film thickness is preferably about 3 mils, although this may vary between about 1 to 4 mils. Though cuprous oxide is essentially the primary component of the anti-fouling layer 16, it is contemplated that additional components may be included, such as a biocide additive, on the order of 5% to 50%, by weight. This additive may have particular advantages in fresh water environments, where as known in the art is a chemical that destroys life by poisoning, such as pesticide, herbicide or fungicide.

Production of the laminate begins with the blended mixture of cuprous oxide and the synthetic rubber which has been reduced with solvents for either spraying or rolling application in a controlled manufacturing environment. The mixture is then applied to the non-porous plastic or synthetic rubber or fourth layer 18, as later discussed. This fourth layer 18 should be selected with its ability to be easily separated from the anti-fouling layer 16, and that there is no chemical reaction with the solvents used in the blended mixture of the product. Returning to the fourth layer 18, this layer provides handling protection to the person applying the laminate to the boat hull, and helps maintain its viability until applied to a boat hull, for instance. This fourth layer 18 or film, having a nominal thickness of about 0.001", is removed after applying the laminate to expose the anti-fouling surface of the anti-fouling layer 16. That is, the fourth layer 18 provides a medium to initiate the production process, a protective layer during the handling process, and finally a laminate that eliminates surface oxidation of the cuprous oxide during storage. Finally, after applying the anti-fouling layer 16 to the fourth layer 18, allowing for adequate solvent flash time, the three layers, i.e. fourth layer 18, third layer 16, and second layer 14, are allowed to cure for about 24 hours. Thereafter, the first layer 12 or transfer adhesive of an acrylic adhesive, with one side of the adhesive exposed for contact, is applied to the cured second layer 14. This adhesive may be accomplished through a press and roll process after alignment. In this form, the laminate may be transported to the receiving object, i.e. boat hull, and with any final protective paper layer removed, applied to the receiving object, and the fourth layer 18 peeled off.

It is recognized that changes, variations and modifications may be made to the anti-fouling laminate of this invention, especially by those skilled in the art, without departing from the spirit and scope thereof. Accordingly, no limitation is intended to be imposed thereon except as set forth in the accompanying claims.

I claim:

1. A removable and replaceable anti-fouling laminate to provide protection to a water submersed object, said laminate comprising:

a.) a first, non-porous transfer adhesive for securing said laminate to said object;

b.) a second, non-porous film to strengthen said laminate;

c.) a third layer having a blended mixture of a synthetic rubber and cuprous oxide; and, d.) a manually removable fourth layer of a non-porous plastic film, removable to expose said third layer for providing anti-fouling protection to said object.

2. The removable and replaceable anti-fouling laminate according to claim 1, wherein said cuprous oxide is present in said mixture in an amount between about 15% to 70%, by weight.

3. The removable and replaceable anti-fouling laminate according to claim 2, where said cuprous oxide is present in an amount between about 20% to 40%.

4. The removable and replaceable anti-fouling laminate according to claim 3, wherein said mixture further includes a biocide.

5. The removable and replaceable anti-fouling laminate according to claim 1, wherein said laminate has a thickness of from 1 to 4 mils.

6. The removable and replaceable anti-fouling laminate according to claim 1, wherein said synthetic rubber is a butyl rubber compound.

7. The removable and replaceable anti-fouling laminate according to claim 1, wherein said object is a boat hull.

8. The removable and replaceable anti-fouling laminate according to claim 1, wherein said transfer adhesive is an acrylic adhesive.

9. The removable and replaceable anti-fouling laminate according to claim 1, wherein to produce said laminate said blended mixture of synthetic rubber and cuprous oxide, said mixture is applied to said fourth layer by a process selected from the group consisting of spraying and rolling, in a controlled manufacturing environment.

10. In combination with the hull of a vessel, where said hull is to be submersed in water and anti-fouling protection is required for the effective and safe operation of said vessel, a laminate to be applied to said hull, said laminate comprising:

a.) a first, non-porous transfer adhesive for contacting and securing said laminate to said hull;

b.) a second, non-porous film to strengthen said laminate;

c.) a third layer having a blended mixture of a synthetic rubber 1 and cuprous oxide; and, d.) a removable fourth layer of a non-porous plastic film, removable to expose said third layer for providing anti-fouling protection to said hull.

11. The combination according to claim 10, wherein said cuprous oxide is present in said mixture in an amount between about 15% to 70%, by weight.

12. The combination according to claim 11, where said cuprous oxide is present in an amount between about 20% to 40%.

13. The combination according to claim 12, wherein said mixture further includes a biocide.

14. The combination according to claim 10, wherein said laminate has a thickness of from 1 to 4 mils.

15. The combination according to claim 10, wherein said synthetic rubber is a butyl rubber.

16. The combination according to claim 10, wherein said transfer adhesive is an acrylic adhesive.

17. The combination according to claim 10, wherein to produce said laminate said blended mixture of synthetic rubber and cuprous oxide, said mixture is applied to said fourth layer by a process selected from the group consisting of spraying and rolling in a controlled manufacturing environment.

* * * * *